United States Patent [19]

Albers

[11] Patent Number: 4,571,937

[45] Date of Patent: Feb. 25, 1986

[54] APPARATUS FOR CONTROLLING THE FLOW OF LEAKAGE AND COOLING AIR OF A ROTOR OF A MULTI-STAGE TURBINE

[75] Inventor: Martin Albers, Munich, Fed. Rep. of Germany

[73] Assignee: MTU - Motoren-und Turbinen-Munchen GmbH, Munich, Fed. Rep. of Germany

[21] Appl. No.: 586,835

[22] Filed: Mar. 6, 1984

[30] Foreign Application Priority Data

Mar. 8, 1983 [DE] Fed. Rep. of Germany ..... 3308140

[51] Int. Cl.[4] ..... F01D 5/18; F01D 5/20

[52] U.S. Cl. ..... 60/39.75; 415/170 R; 415/115; 416/92; 416/97 R

[58] Field of Search ..... 416/92, 97 R, 95; 415/115, 116, 172 A, 170 R, 110; 60/39.75

[56] References Cited

U.S. PATENT DOCUMENTS

| | | | |
|---|---|---|---|
| 881,474 | 3/1908 | Jude . | |
| 3,011,762 | 12/1961 | Pouit | 415/172 A |
| 3,575,523 | 4/1971 | Gross | 415/172 |
| 3,867,061 | 2/1975 | Moskowitz | 415/174 |
| 3,876,330 | 4/1975 | Pearson et al. | 416/92 |
| 4,017,209 | 4/1977 | Bodman | 416/97 R |
| 4,127,358 | 11/1978 | Parkes | 416/97 R |
| 4,224,011 | 9/1980 | Dodd et al. | 416/192 X |
| 4,370,094 | 1/1983 | Ambrosch et al. | 415/172 A |
| 4,424,001 | 1/1984 | North et al. | 415/172 A X |

FOREIGN PATENT DOCUMENTS

| | | | |
|---|---|---|---|
| 2000314 | 7/1971 | Fed. Rep. of Germany . | |
| 2350624 | 5/1974 | Fed. Rep. of Germany | 415/172 A |
| 2462465 | 4/1977 | Fed. Rep. of Germany . | |
| 2404101 | 4/1979 | France . | |
| 1364511 | 8/1974 | United Kingdom . | |

*Primary Examiner*—Carlton R. Croyle
*Assistant Examiner*—Jeffrey A. Simenauer
*Attorney, Agent, or Firm*—Roberts, Spiecens and Cohen

[57] ABSTRACT

A muilti-stage turbine having shrouded turbine blades which has a stationary guide grid arranged between the rotor shroud and the turbine casing. By virtue of the construction of the guide grid, leakage and cooling air (escape air) of the rotor blade can be adapted to the low whirl of the main stream passing through the rotor to effectively prevent misaligned entry into the following turbine stage.

9 Claims, 4 Drawing Figures

APPARATUS FOR CONTROLLING THE FLOW OF LEAKAGE AND COOLING AIR OF A ROTOR OF A MULTI-STAGE TURBINE

FIELD OF THE INVENTION

The present invention relates to a multi-stage turbine having rotor blades surrounded by a shroud and adapted for controlling the flow of air leaking between the shroud and the turbine casing and of cooling air from one turbine stage to the next.

PRIOR ART

Multi-stage turbines are generally designed so that the fluid stream leaves each of the individual turbine stages with only a little whirl or without any whirl. The subsequent or following turbine stage is designed for an inlet whirl and whirl corresponding to the outlet angle of discharge at the previous stage. Leakage air of the shroud seal as well as cooling air emerging from the rotor blades have, on the other hand, high whirl. This air mixes behind the turbine stage with the main stream of lesser whirl and causes misaligned entry into the inlet guide vanes of the following turbine stage, especially, in the region of the casing. As a result of the unutilized whirl of the cooling and leakage air and as a result of the misaligned entry into the following turbine stage, substantial losses in efficiency are produced.

It has already been attempted to solve this problem by so-called "tip fences". These are secondary blades provided on the outer side of the shroud on the rotor which act to remove a part of the whirl of the cooling and leaking air and thereby simultaneously serve to improve the efficiency. However, such secondary blades on the rotor have the result that the outlet pressure of the cooling air from the turbine blades is increased and blade cooling is thus impaired. A larger quantity of cooling air and/or increased supply pressure of the cooling air is thus necessary. Furthermore, the secondary blades on the shroud of the rotor lead to a higher blade weight and thus to increased disc rim loads and therefore also result in strength problems, particularly for the reason that the short blades turn with high speed in operation together with the rotor blades.

SUMMARY OF THE INVENTION

An object of the invention is to provide improvements in turbine construction to overcome the deficiencies noted in respect of the prior art.

It is a further object of the invention to provide a multi-stage shrouded turbine with turbine blades of the aforementioned type in which substantially no efficiency losses occur in operation as a result of misaligned flow angle of fluid entry into the subsequent turbine stage, this being effected by simple means which do not impair the dynamic operating properties of the rotor.

The above and further objects of the invention are achieved by the provision of a stationary guide assembly between the rotor shroud and the turbine casing in order to adapt the direction of the leaking and of the cooling air to the direction of the main stream of fluid passing through and emerging from the rotor for entry into a subsequent turbine stage.

The guide assembly is preferably constructed as a closed, annular band with internal short vanes. The rear end of the rotor shroud is advantageously constructed to form a contact-free seal with the closed annular band. The guide assembly is preferably detachably fastened to the casing. In order to facilitate its installation and replacement, the closed, annular band may be formed of several angular segments.

In further accordance with the invention, the guide assembly can be arranged in offset relation towards the low pressure side in the axial direction of the turbine with respect to the blade rotor so that the peripheral edge of the rotor shroud at the low pressure side lies approximately in the axial center of the guide assembly.

The short vanes may be adjustable on the guide assembly to adjust the angle of entry for the leakage and cooling air into the vanes of the guide assembly.

By means of the invention, therefore, the leakage air through the shroud seal and the stream of cooling air emerging radially from the turbine blades can be adapted to the main stream of lower whirl downstream of the turbine blades in the region in front of the subsequent turbine stage, whereby misaligned entry into the subsequent turbine stage is prevented and thus practically no losses in efficiency are produced.

The guide assembly can be shaped and dimensioned to be smaller in respect of strength and weight than in the case of the rotating "tip fences" in accordance with the prior art.

Furthermore, the guide assembly causes a reduction in pressure between the rotor shroud and the casing. For the cooling of the blades, there is thus available a greater pressure gradient and the effectiveness of the cooling is increased. It is therefore possible to decrease the quantity of cooling air and/or the delivery pressure of the cooling air or to simplify the cooling design of the blades.

It should be understood that this invention has application in all types of turbines. It is particularly effective for gas turbine engines as in jet engines of an aircraft.

Other features and advantages will be apparent from the accompanied drawings and description of the preferred embodiment of the invention without being limited thereto.

BRIEF DESCRIPTION OF THE FIGURES OF THE DRAWING

The invention will be described below with reference to an illustrative embodiment shown in the drawing, in which.

DETAILED DESCRIPTION

Figure 1:
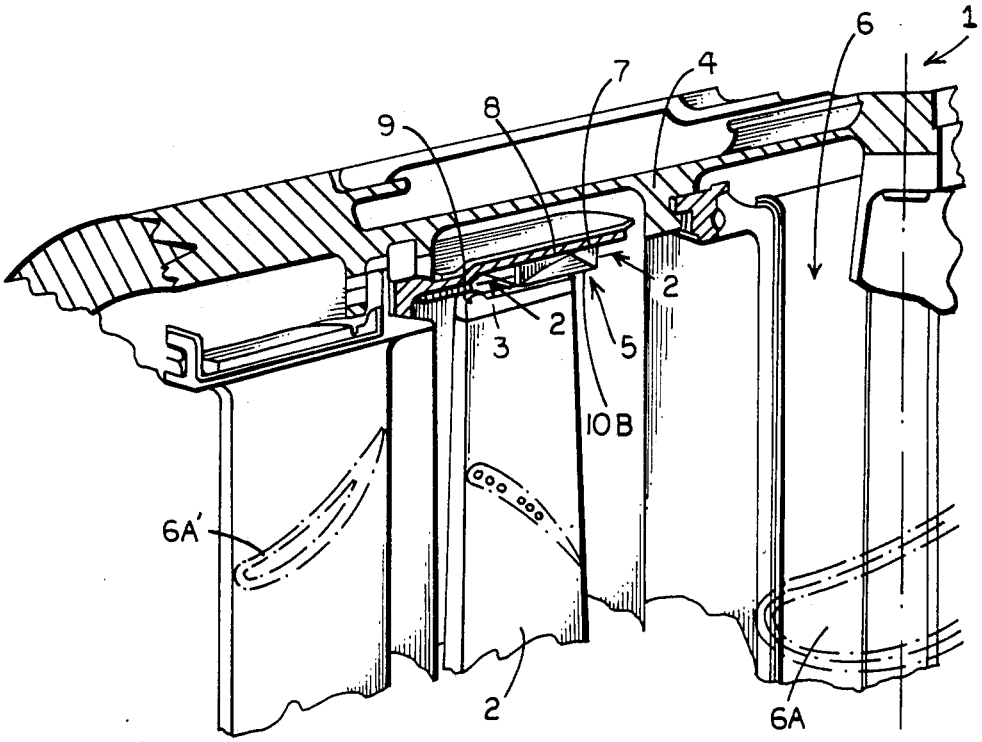
FIG. 1 is an axial diagrammatic section through a portion of a multi-stage turbine having a shroud.

The multi-stage shroud turbine shown diagrammatically in FIG. 1 is designed essentially in known manner. In its highpressure section it employs a blade rotor 2 with an integral outer shroud 3 which rotates with the rotor. The subsequent turbine stage is indicated by numeral 6 whereat there is visible the stationary guide vane assembly 6A or stator thereof. The guide vane assembly for rotor 2 is diagrammatically illustrated at 6A'.

Figure 2:
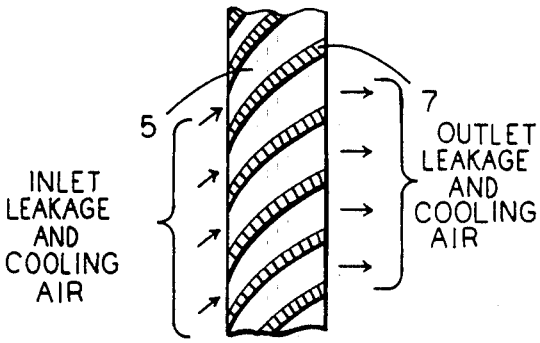
FIG. 2 is a diagrammatic section taken along line 2—2 in FIG. 1.
Figure 4:
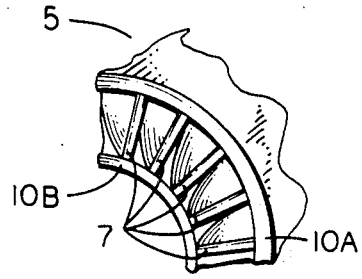
FIG. 4 is a diagrammatic perspective view of a portion of the guide grid of the invention.

Between the shroud 3 of the blade rotor 2 and the peripheral casing 4 of the turbine there is a stationary guide assembly or grid 5, a portion of which is shown in detail in FIGS. 2 and 4.

The grid 5 has an outer annular band 10A and an inner annular band 10B between which are arranged internal guide vanes 7. The vanes 7 can be fixed to the bands 10A, 10B or they can be angularly adjustable for a purpose to be explained in detail later. The grid 5 constitutes a rigid assembly which is fastened to the casing 4 in the arrangement shown in FIGS. 1 and 3.

Figure 3:
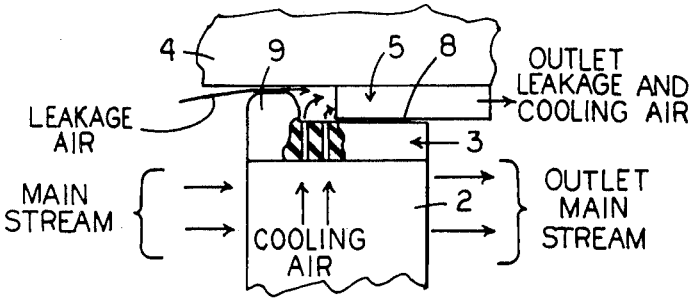
FIG. 3 is an elevational view, partly broken away and in section of a portion of a rotor stage at its outer periphery.

As seen in FIG. 3 leakage air which passes the seal 9 of the shroud 3 with the casing 4 can enter the inlet or upstream end of the grid 5. Similarly, cooling air which flows through holes in the rotor blades 2 and escapes through holes in the shroud 3 can also enter the inlet end of grid 5. The vanes 7 guide the flow of leakage and cooling air through the grid 5 and serve as internal guide vanes.

The main stream of fluid which passes through the rotor to impart rotation thereto undergoes little or no whirl and the stagger angle of the blades 6A of the guide vanes is arranged in relation to the exit angle of the main stream at the outlet end of the rotor blades 2. The vanes 7 of the grid 5 are arranged to impart an exit angle to the discharged cooling and leakage air which is substantially equal to the exit angle of the main stream from the rotor. In the absence of the grid 5, the leakage and cooling air would undergo substantial whirl and adversely affect the angle of incidence of the following turbine stage guide vanes 6A particularly at the tip region thereof.

The connection of the vanes 7 in the grid to permit angular adjustment thereof allows the vanes 7 to be adapted at the time of installation of the grid to different stagger angles for the incoming air or to comply with different angles of the rotor blades. Thereby, the grid 5 can be employed with rotors having different blade angles.

The grid 5 is detachably connected to the casing 4 to enable it to be replaced should this become necessary. The grid 5 can be composed of a plurality of angular segments to permit replacement of only a portion of the grid 5 should this be required.

The guide grid 5 is axially arranged in the turbine 1 so that the outer peripheral edge 8 of the shroud 3 at the low pressure side lies approximately in the axial center of the guide grid 5 and closely adjoins but without contact, the annular band 10B.

The short vanes 7 are so arranged in accordance with FIG. 2 that the cooling air emerging radially outward from the rotor blade 2 and any leakage air passing through the seal 9 of the shroud are adapted to the main stream of lower whirl behind the blade rotor 2 so that no misaligned entry takes place in the subsequent turbine stage 6.

Although the invention has been described in relation to a specific embodiment thereof, it will become apparent to those skilled in the art that numerous modifications and variations can be made within the scope and spirit of the invention as defined in the attached claims.

What is claimed is:

1. A multi-stage turbine comprising a casing, a rotor in said casing for extracting energy from an inlet fluid stream and discharging the fluid stream, at a low pressure discharge end of the rotor, at a given direction to a subsequent turbine stage, said rotor including a plurality of spaced rotor blades and a peripheral shroud on said blades to cover the blades, said shroud having holes for passage therethrough of cooling air which flows radially outwards from the blades, said shroud and casing forming a leakage path for flow of leakage air between the shroud and casing, and a stationary guide assembly secured to said casing and extending between said shroud and casing, said guide assembly including guide grid means for receiving said cooling air and said leakage air to combine the same and guide it for discharge from the rotor to the subsequent turbine stage at said direction substantially corresponding to the angle of discharge of said fluid stream from said rotor, said guide assembly being axially offset relative to said rotor blades at the low pressure discharge ends thereof.

2. A turbine as claimed in claim 1 wherein said guide grid means comprises an annular guide grid including internal vanes spaced around said grid.

3. A turbine as claimed in claim 2 wherein said shroud on the rotor has a downstream end shaped to form a contact free seal with said guide grid.

4. The improvement as claimed in claim 2 wherein said guide grid is detachably connected to the casing.

5. The improvement as claimed in claim 2 wherein said guide includes a plurality of angular segments.

6. The improvement as claimed in claim 2 wherein the guide grid vanes are angularly adjustable in said grid.

7. A turbine as claimed in claim 1 wherein said guide assembly has an inlet located downstream of said holes in the shroud, said guide assembly projecting beyond the discharge end of the rotor and having an outlet for the discharge of the combined cooling air and leakage air downstream of the discharge end of the rotor.

8. A turbine as claimed in claim 2 wherein said guide grid means further comprises inner and outer bands between which said internal vanes are interposed.

9. A turbine as claimed in claim 1 wherein the guide grid is axially offset from towards the downstream ends of the rotor blades such that the downstream end of the shroud is centrally disposed axially relative to said guide grid.

* * * * *

UNITED STATES PATENT AND TRADEMARK OFFICE

CERTIFICATE OF CORRECTION

PATENT NO. : 4,571,937

DATED : February 25,1986

INVENTOR(S) : ALBERS

It is certified that error appears in the above—identified patent and that said Letters Patent is hereby corrected as shown below:

The assignee should read as follows:

--MTU-MOTOREN- UND TURBINEN-UNION
MUNCHEN GMBH--

Signed and Sealed this

*Twelfth* Day of *August 1986*

[SEAL]

*Attest:*

DONALD J. QUIGG

*Attesting Officer*

*Commissioner of Patents and Trademarks*